US010774499B2

(12) United States Patent
Ollinger, IV et al.

(10) Patent No.: US 10,774,499 B2
(45) **Date of Patent: *Sep. 15, 2020**

(54) LIP FOR EXCAVATING BUCKET

(71) Applicant: ESCO Corporation, Portland, OR (US)

(72) Inventors: Charles G. Ollinger, IV, Portland, OR (US); Joel S. Hankland, Canby, OR (US); Kevin S. Stangeland, Portland, OR (US)

(73) Assignee: ESCO GROUP LLC, Portland, OR (US)

( * ) Notice: Subject to any disclaimer, the term of this patent is extended or adjusted under 35 U.S.C. 154(b) by 95 days.

This patent is subject to a terminal disclaimer.

(21) Appl. No.: 15/834,557

(22) Filed: Dec. 7, 2017

(65) Prior Publication Data

US 2018/0094399 A1 Apr. 5, 2018

Related U.S. Application Data

(62) Division of application No. 13/906,085, filed on May 30, 2013, now Pat. No. 9,963,853.

(60) Provisional application No. 61/654,501, filed on Jun. 1, 2012.

(51) Int. Cl.

| | |
|---|---|
| ***E02F 9/28*** | (2006.01) |
| ***E02F 3/40*** | (2006.01) |
| ***E02F 3/60*** | (2006.01) |

(52) U.S. Cl.

CPC ..... *E02F 3/40* (2013.01); *E02F 3/60* (2013.01); *E02F 9/2816* (2013.01); *E02F 9/2883* (2013.01)

(58) Field of Classification Search

CPC ..... E02F 9/28; E02F 9/2816; E02F 9/2825; E02F 9/285; E02F 9/2858; E02F 9/2883

See application file for complete search history.

(56) References Cited

U.S. PATENT DOCUMENTS

| | | | |
|---|---|---|---|
| 1,208,054 | A | 12/1916 | Vanderhoef |
| 1,582,577 | A | 4/1926 | Crane |
| 1,642,189 | A | 9/1927 | Bager et al. |
| 1,908,883 | A | 5/1933 | Black |
| 1,914,104 | A | 6/1933 | Black |
| 1,920,703 | A | 8/1933 | Llewellyn |
| 1,959,847 | A | 5/1934 | Buskirk |
| 2,091,974 | A | 9/1937 | Fykse |
| 2,427,897 | A | 9/1947 | Burdick |
| 2,926,800 | A | 3/1960 | Larson et al. |
| 3,107,445 | A | 10/1963 | Ratkowski |
| 3,307,277 | A | 3/1967 | Kondracki |

(Continued)

FOREIGN PATENT DOCUMENTS

| | | |
|---|---|---|
| WO | WO 2008/140993 | 11/2008 |
| WO | WO 2010/049546 | 5/2010 |

(Continued)

OTHER PUBLICATIONS

ESCO CORP, Images of lips for excavating buckets, Part Nos. EC148S130, EC163S130, EC169S110, EC169S130, EC169S145, EC201S130, EC201S145, and EC220S145, sold before May 30, 201.

*Primary Examiner* — Matthew Troutman
(74) *Attorney, Agent, or Firm* — Steven Schad

(57) ABSTRACT

A lip for an excavating bucket with a front beam and a rear beam extending along the length of the lip and defining at least one recess between them. The front beam includes noses extending forward of the beam for mounting ground engaging tools. Ribs extend between the front beam and the rear beam. The ribs separate recesses extending between the beams.

40 Claims, 14 Drawing Sheets

(56) References Cited

U.S. PATENT DOCUMENTS

| | | | |
|---|---|---|---|
| 3,851,413 | A | 12/1974 | Lukavich |
| 4,129,952 | A | 12/1978 | Olson |
| 4,238,896 | A | 12/1980 | Lanz et al. |
| 4,407,081 | A | 10/1983 | Hanson |
| 4,414,764 | A | 11/1983 | Johansson et al. |
| 4,570,365 | A | 2/1986 | Bierwith |
| 4,748,754 | A | 6/1988 | Schwappach |
| 5,016,365 | A | 5/1991 | Robinson |
| 5,077,918 | A | 1/1992 | Garman |
| 5,412,885 | A | 5/1995 | Cornelius |
| 5,526,592 | A | 6/1996 | Bierwith |
| 1,921,491 | A | 8/1996 | Buskirk |
| 5,553,409 | A | 9/1996 | Irving |
| 5,713,145 | A | 2/1998 | Ruvang |
| 5,852,888 | A | 12/1998 | Cornelius |
| 5,901,480 | A | 5/1999 | Shamblin |
| 6,151,812 | A | 11/2000 | Bierwith |
| 6,240,663 | B1 | 6/2001 | Robinson |
| D478,599 | S | 8/2003 | Zaayman |
| 6,668,472 | B2 | 12/2003 | Bierwith |
| 6,751,897 | B2 | 6/2004 | Bierwith |
| 6,834,449 | B2 | 12/2004 | Leslie et al. |
| 6,839,990 | B2 | 1/2005 | Leslie et al. |
| 6,952,892 | B1 | 10/2005 | Bierwith |
| 6,986,216 | B2 | 1/2006 | Emrich et al. |
| 6,990,760 | B1 | 1/2006 | Zaayman et al. |
| D537,846 | S | 3/2007 | Block |
| 7,559,162 | B2 | 7/2009 | Bierwith |
| D631,490 | S | 1/2011 | Drager et al. |
| 8,707,589 | B2 | 4/2014 | Hilton |
| 9,840,828 | B2 | 12/2017 | Bierwith |
| 2010/0005689 | A1 | 1/2010 | Leslie et al. |
| 2011/0167682 | A1 | 7/2011 | Leslie et al. |

FOREIGN PATENT DOCUMENTS

| | | |
|---|---|---|
| WO | WO 2011/075782 | 6/2011 |
| WO | WO 2012/162424 | 11/2012 |

LIP FOR EXCAVATING BUCKET

This application is a divisional of pending application Ser. No. 13/906,085, filed May 30, 2013, entitled "Lip for Excavating Bucket" which claims priority to U.S. Provisional Patent Application No. 61/654,501, filed Jun. 1, 2012. Each of these applications are incorporated by reference herein in its entirety and made a part hereof.

FIELD OF THE INVENTION

The present invention pertains to a lip for an excavating bucket, and particularly to a cast lip for use with excavating machines such a dragline machines, cable shovels, face shovels, hydraulic excavators and the like.

BACKGROUND OF THE INVENTION

Excavating machines, such as used in mining and construction operations, include buckets that are driven into the ground to gather a load of earthen material. The bucket is generally defined by a rear wall, a bottom wall and sidewalls to define a cavity with an open front for receiving the excavated material. The front edge of the bottom wall is provided with a lip on which ground engaging tools such as teeth, adapters and/or shrouds are generally attached to protect the lip against wear and to better break up the ground during digging. The lips are either formed of plate steel (which are called plate lips) or by a casting process (which are called cast lips). Either style of lip is welded into the bucket, i.e., to the front edge of the bottom wall and to the lower, front corners of each sidewall.

Cast lips are generally used on larger excavating machines such as dragline machines, cable shovels, face shovels, and hydraulic excavators. These lips are large steel structural members able to withstand the impact and other heavy loading experienced as the bucket is driven through the ground, resist undue wearing caused by the high abrasion environment, and securely support and hold the ground engagement tools in place for efficient digging. Accordingly, cast lips tend to be very heavy, which reduces the load each bucket can gather in each digging cycle. That is, excavating machines are designed for certain maximum loads, which include the weight of the excavated material as well as the weight of the bucket.

Existing lips typically have a structure that resists the many loads encountered in a digging operation and tends to carry the cantilevered tooth loads in torsion. The lips, however, tend to be massive and heavy to survive the very large loads and high abrasion environments commonly encountered in a digging operation and particularly in many mines. Mining and other excavating machines are constructed to lift loads up to a certain specified level. The more weight that exists in the lip, wear parts and other components of the bucket, the smaller the maximum payload that can be achieved by the bucket. The great size and weight also tends to increase manufacturing difficulties and cost of cast lips.

SUMMARY OF THE INVENTION

The present invention is a lip design of reduced weight that provides the requisite strength and durability needed for satisfactory operation.

In one aspect of the invention, a lip for an excavating bucket comprises front and rear beams extending across the lip to provide resistance to heavy loading during use, and recesses between the beams to reduce the weight of the lip.

In another aspect of the invention, a lip for an excavating bucket comprises a pair of spaced beams extending along the length of the lip, ribs interconnecting the spaced beams, and recesses between the beams and the ribs.

In another aspect of the invention, a lip for an excavating bucket has one or more recesses that comprise a substantial portion of the entire lip volume for an advantageous weight-savings construction. In the present invention, the total collective volume of the recesses is at least about 15%, and preferably at least about 18% or more, of the total volume of the lip including the volume of the recesses.

In another aspect of the invention, an excavator bucket comprises a plurality of walls defining a cavity into which is gathered earthen material, and a lip secured to the front of the bucket to define the leading digging edge. The lip includes a front beam spanning the lip with noses extending forward of the front beam for mounting ground engaging tools and a rear beam spanning the lip and abutting a front portion of the excavator bucket.

DETAILED DESCRIPTION OF THE PREFERRED EMBODIMENTS

The present invention pertains to a lip for excavating buckets such as used with dragline machines, cable shovels, face shovels, hydraulic excavators and the like. The lip includes a dual beam construction and recessed portions to reduce the lip weight while maintaining the needed strength and resistance to bending and twisting.

Figure 1:
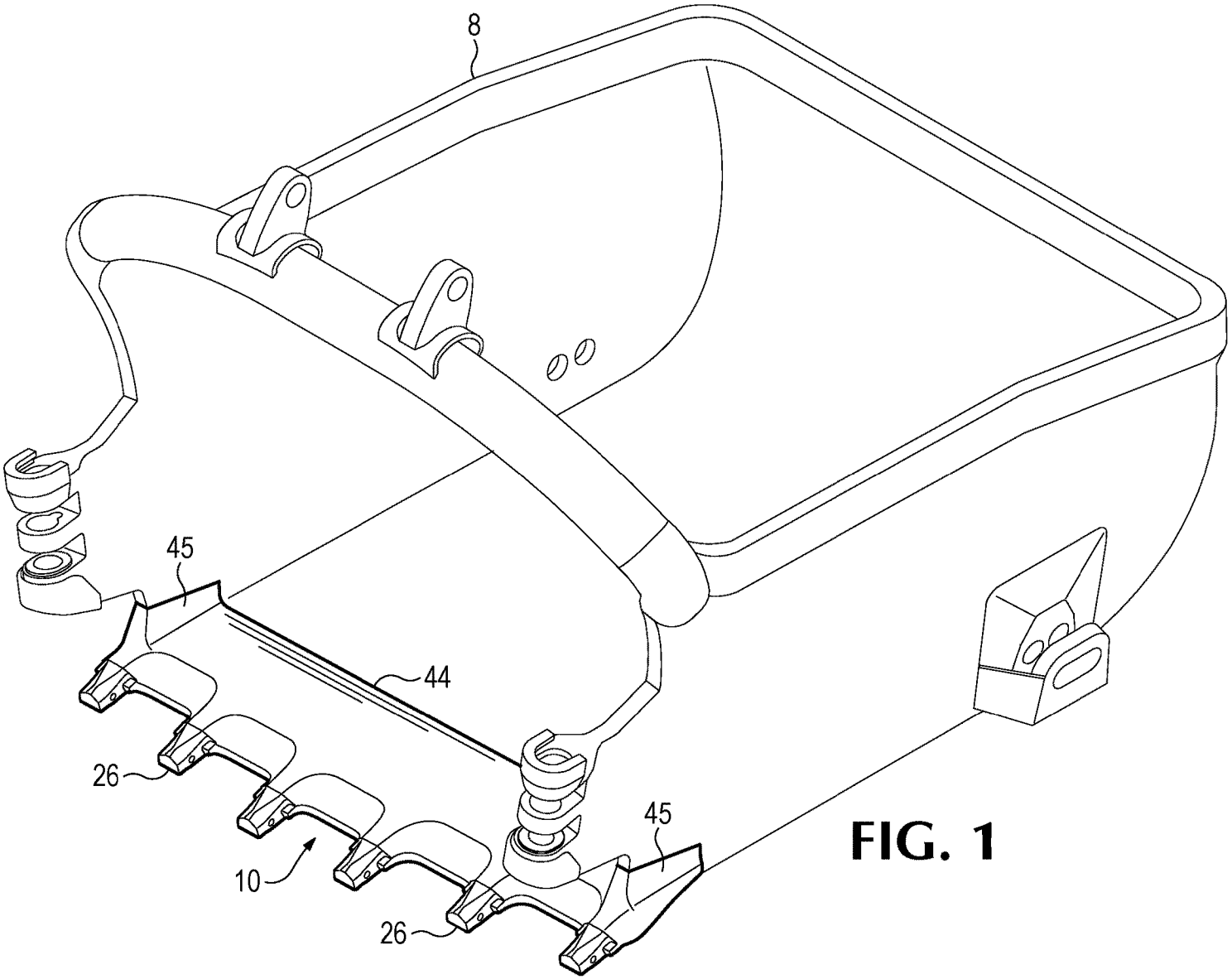
FIG. 1 is a perspective view of an excavating bucket with a lip in accordance with the present invention.
Figure 2:
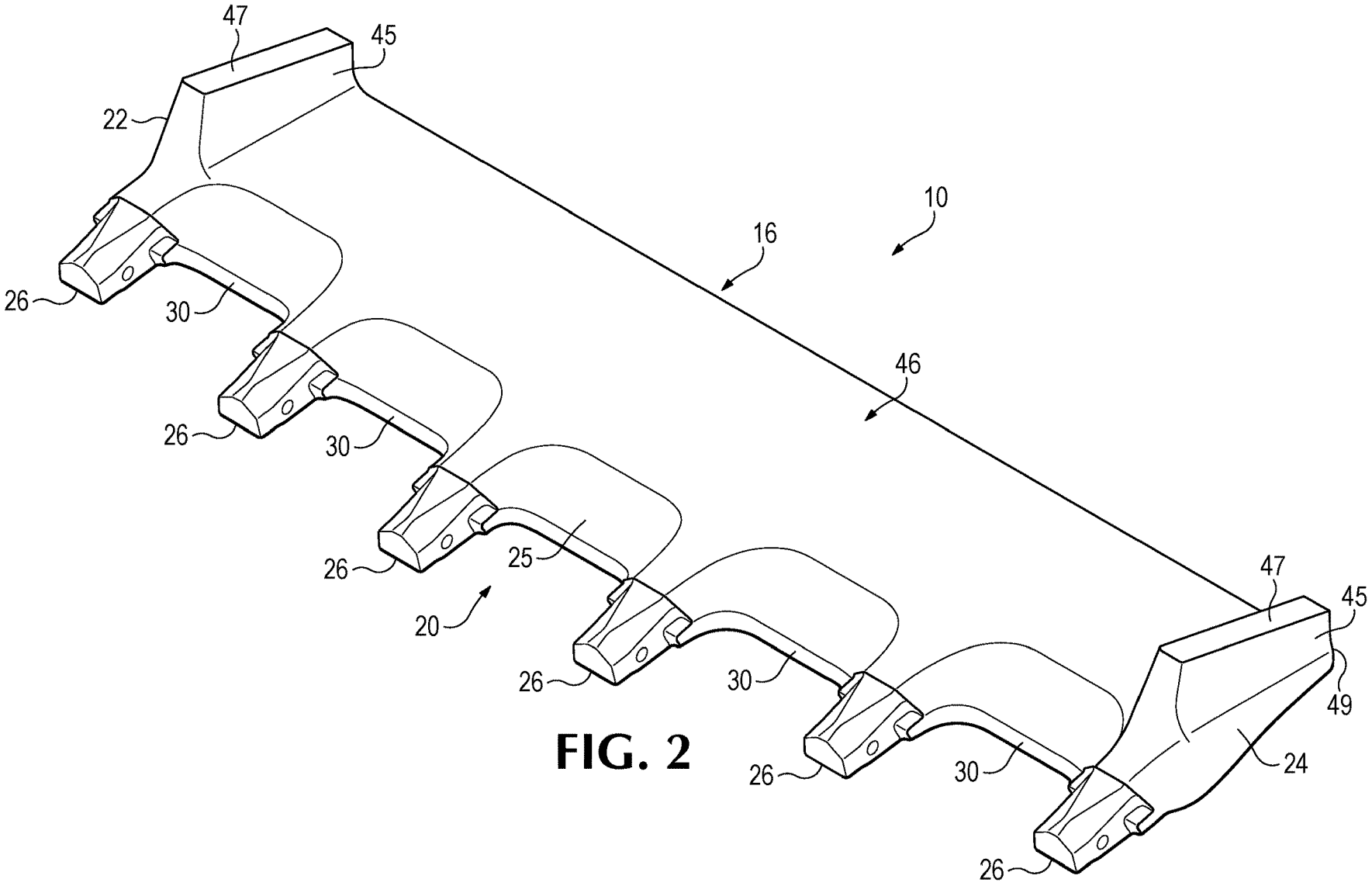
FIG. 2 is a perspective view of an inventive lip.
Figure 3:
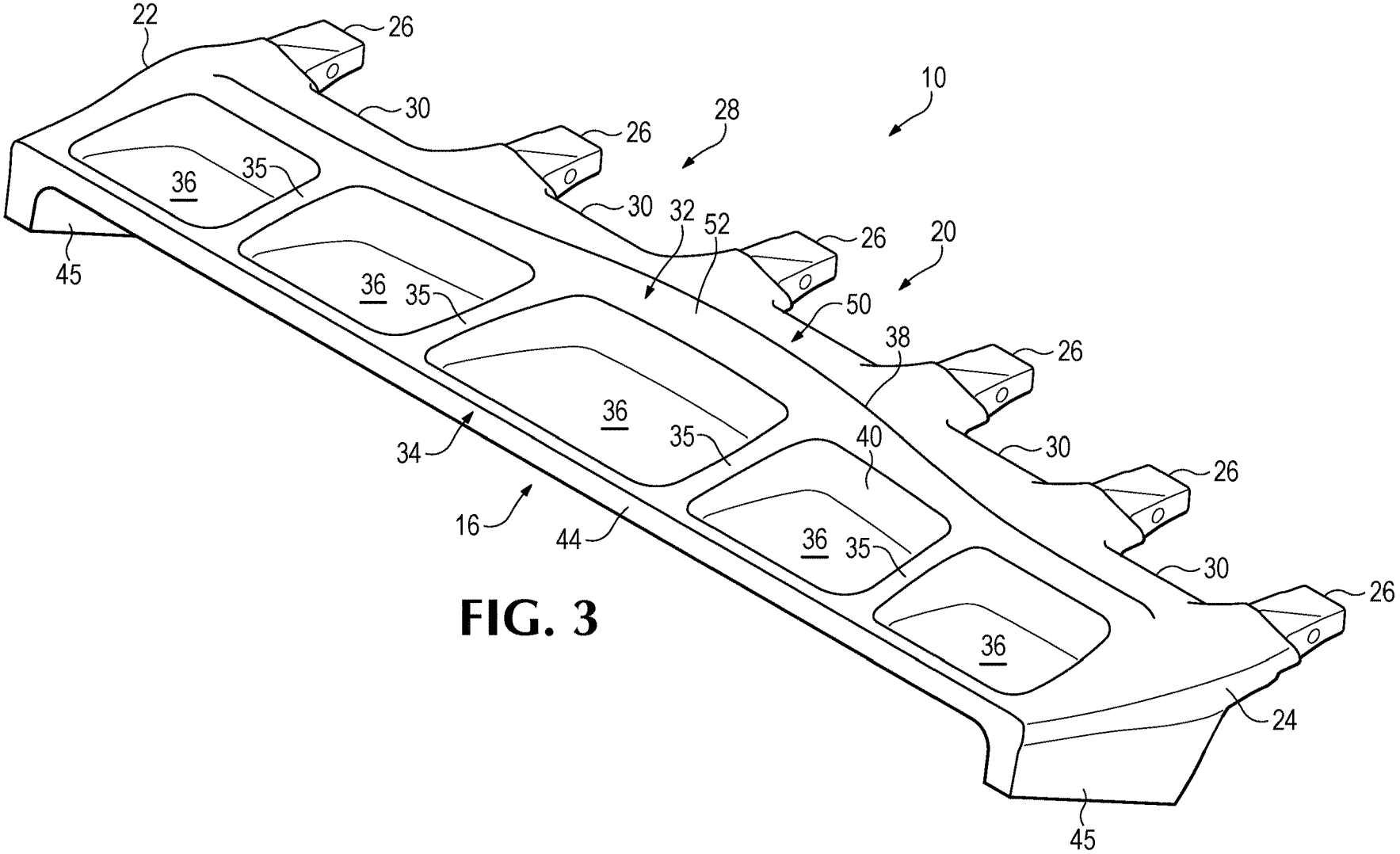
FIG. 3 is a bottom perspective view of the inventive lip.

A lip 10 in FIG. 1 in accordance with the present invention is welded at a back face 44 and along wings or ears 45 to bucket body 8. Lip 10 has an elongate construction extending between the opposite sidewalls of the bucket body 8. In this application, due to the elongated nature of the lip, the length of the lip is considered the long dimension that extends between the sidewalls of the bucket, even though this dimension is sometimes referred in the industry as the bucket or lip width. The lip includes a set of noses 26 spaced along the lip length and extending forward of the main lip structure for mounting ground engaging tools. Lip 10 is more fully illustrated in FIGS. 2-15.

Figure 4:
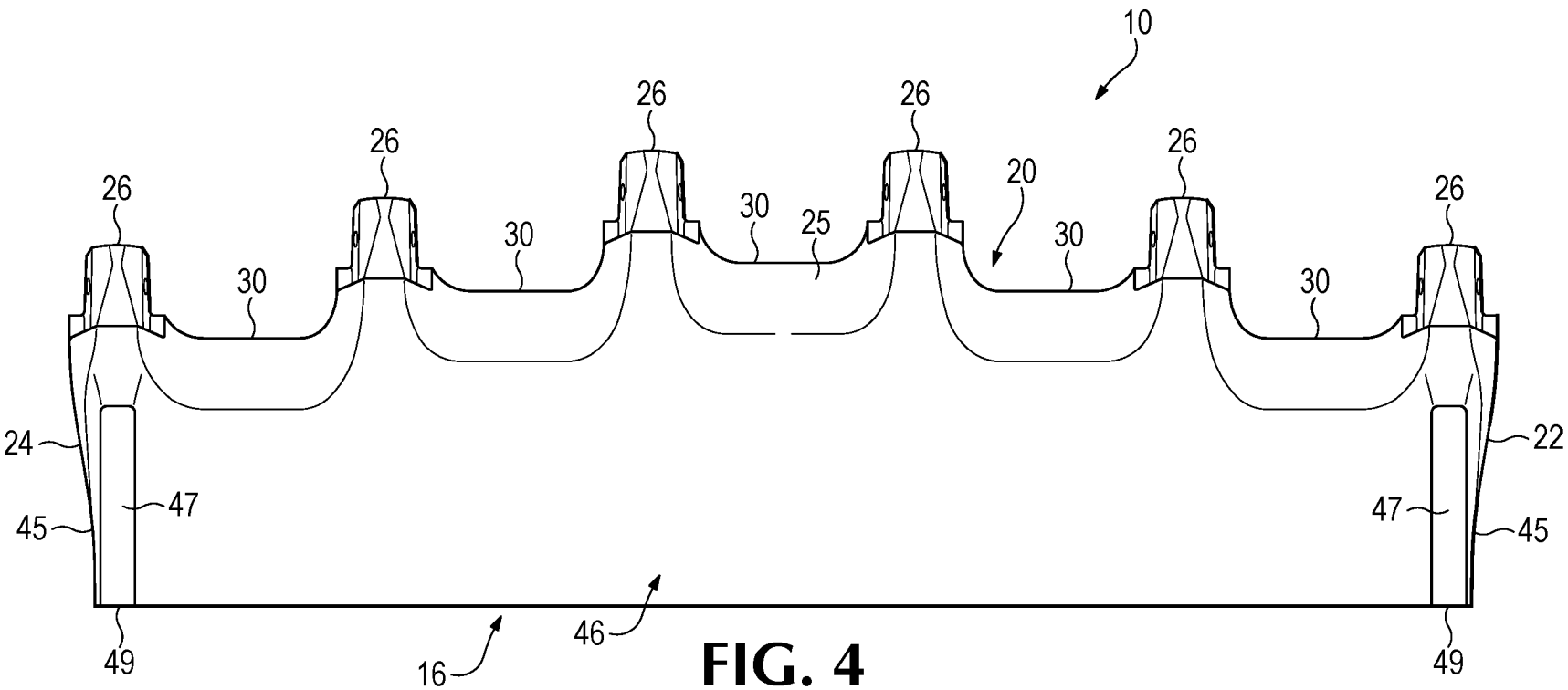
FIG. 4 is a top view of the inventive lip.
Figure 4A:
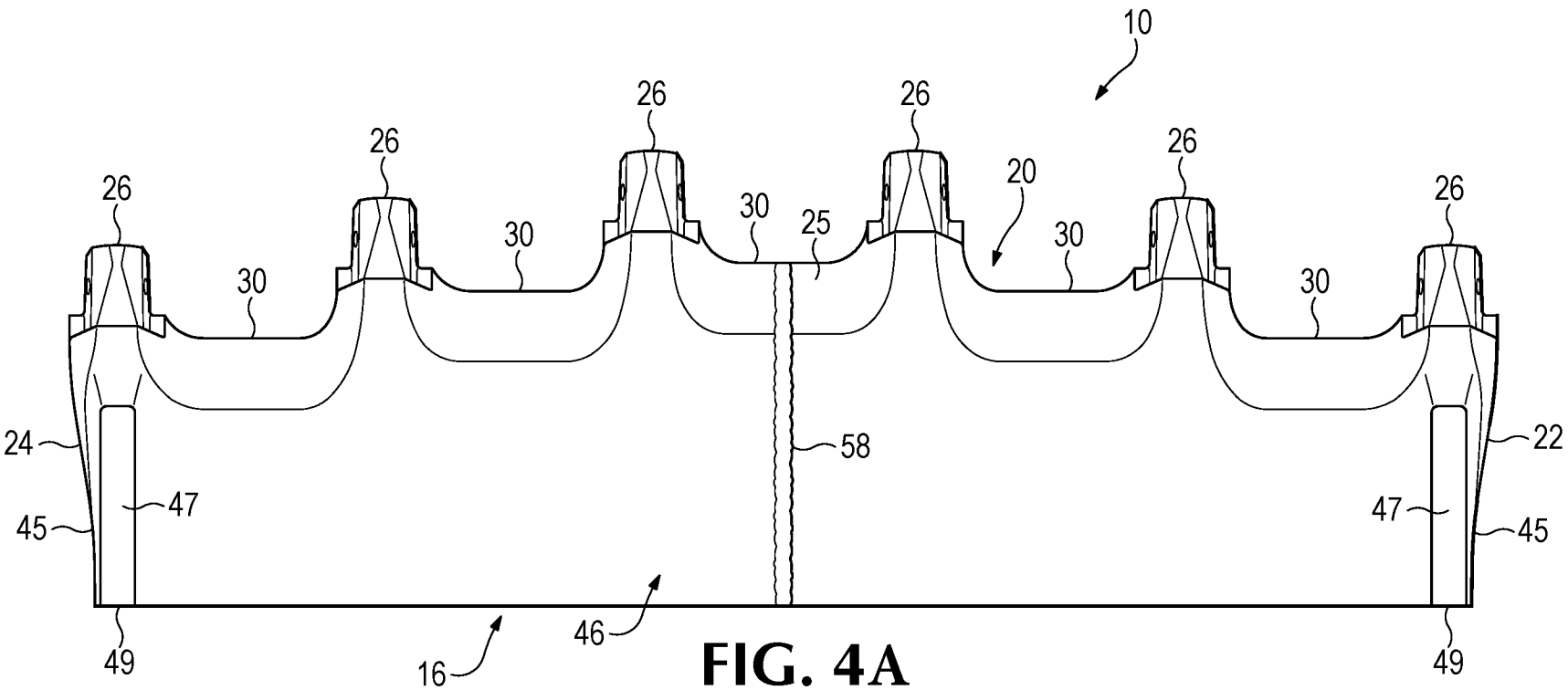
FIG. 4A is a top view of another embodiment of an inventive lip.

Lip 10 includes a rear side 16 with rear face 44, a front side 20, and opposite ends 22, 24. Front side 20 defines a mounting portion 25. Mounting portion 25 forward of beam 32 comprises a series of spaced apart noses 26. Noses 26 receive ground engaging tools such as intermediate adapters or points (not shown) that separate material and direct the material into the bucket while protecting the lip. Noses on the mounting portion are separated by mounting areas 30 for attaching additional ground engaging tools such as shrouds (not shown). Lip 10 is preferably a cast lip, though it could be formed of parts (preferably cast parts) welded 58 together (FIG. 4A).

In the illustrated embodiment, lip 10 is a stepped lip such that the front side 20 is stepped forward toward the center so that the noses 26 closer to the center of the lip are farther forward than those closer to ends 22, 24 with portions between the noses extending generally along the length of the lip. A lip in accordance with the present invention, though, could have a spade configuration with intermediate portions between the noses inclined to the length of the lip, or reversed step or reverse spade configurations. Further, although lip 10 is shown as linear in front view, it could be bowed or angled vertically across its length, and/or include ends that curve upward.

A support structure 28 of the lip is rearward of and supports mounting portion 25. Support structure 28 is formed to resist all kinds of loads and turning and bending forces encountered during a digging operation. In the present invention, members forming the support structure include a front beam 32 and a rear beam 34 extending along the length of the lip with at least one recess between the two beams. Conventional lips are formed with a single beam structure to resist the very high loads in a digging operation, particularly the large mining machines. While the single beam structure provides adequate strength and support, the lips tend to be massive and heavy. Some existing lips have recesses, but the weight savings is limited due to the mass that has been required to adequately counter the high loads.

Ribs 35 preferably extend between beams 32, 34 to better couple the beams and transfer loads from the noses 26 to the bucket. The ribs subdivide the space between the beams to define a set of recesses 36 between beams 32, 34. Beams 32, 34 and ribs 35 are of a substantial depth or thickness relative to the lip along recesses 36. Recesses are defined by rear surface 40 of front beam 32 and front surface 42 of rear beam 34, and the side surfaces of ribs 35.

Beams 32 and 34 are free of substantial or sudden changes in dimension, and are generally continuous between ends 22 and 24; though they may terminate prior to the actual ends. Superficial changes in the beam structure are possible so long as the primary bulk of each beam as a generally continuous and uninterrupted extension along the length of the lip. The beam can incorporate curves in extending across the lip. Curves in the beam preferably coincide with the intersection of a rib to compensate for stress concentrations induced by the curve. This generally continuous and uninterrupted construction gives the lip a dual beam construction to resist heaving loads and twisting despite the presence of recesses 36. Various changes in beam configuration are possible without departing from the invention. For example, the depth of beam 32 may taper out before the ends. Alternatively, the beams may taper from the ends 22, 24 towards the center of the lip. In the illustrated embodiment ends 22, 24 have wings 45 for welding to sidewalls 12 of the bucket at upper surface 47 and rear surface 49. Wings 45, in this embodiment, extend above the main portion of the lip.

Preferably, lip 10 is generally smooth and continuous along its upper surface 46 for unobstructed loading of the earthen material into the bucket. The lower surface 50 of the lip is structured for weight savings with the beams 32, 34, recesses 36, and ribs 35. Nevertheless, upper surface 46 and lower surface 50 could have other configurations. For example, recesses 36 are preferably open, but they could be enclosed by a plate welded over the bottom, e.g., between beams 32, 34.

Figure 15:
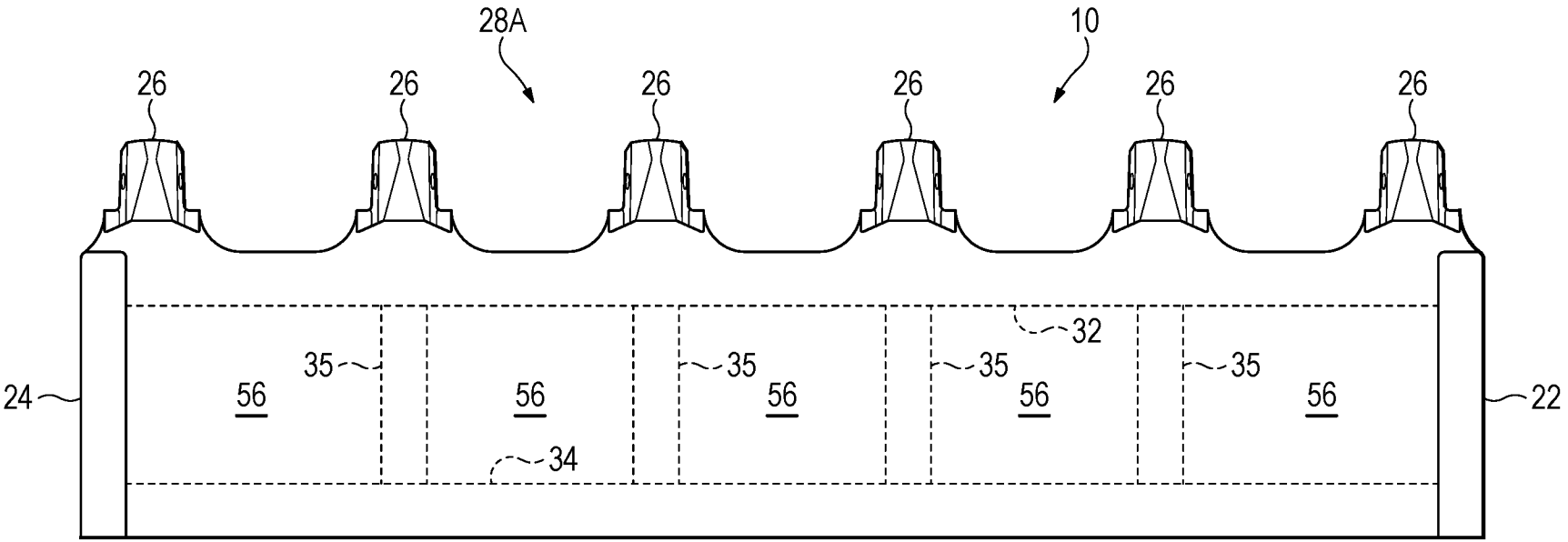
FIG. 15 is a top view of the inventive lip.

The top surface 46 of lip 10 can be considered as a panel support structure 28A that couples front beam 32 to rear beam 34. Ribs 35 also preferably join the beams and resist axial and twisting forces as the bucket moves forward through the excavated material. Additionally, one or more panels 56 can be secured to and connect ribs 35 and beams 32, 34 along the underside of the lip to enclose recesses 36 (FIG. 15). The panel or panels provide additional stiffness and support to the lip, and absorb side forces applied to the front of the structure as torsion and warping. The lip structure can be considered a honeycomb with square cells and one side of the cells covered by a structural sheet. The structure also resembles a semi-monocoque construction as compared to the massive single beam constructions of existing lips.

In a preferred embodiment, front beam 32 is oriented forward in the lip 10, i.e., just rearward of mounting portion 25 to provide greater strength and stability to the wear parts. Front surface 38 of front beam 32 slopes upward from supporting structure 25 to define a smooth transition between beam 32 and ground engaging tool mounts. The beam 32 generally has a greater depth than mounting portion 25. Rear surface 40 of front beam 32 transitions to recessed portion 36. The bottom surface 54 of beam 32 also preferably slopes rearward to reduce wearing during digging, but could have different orientations.

Figure 5:
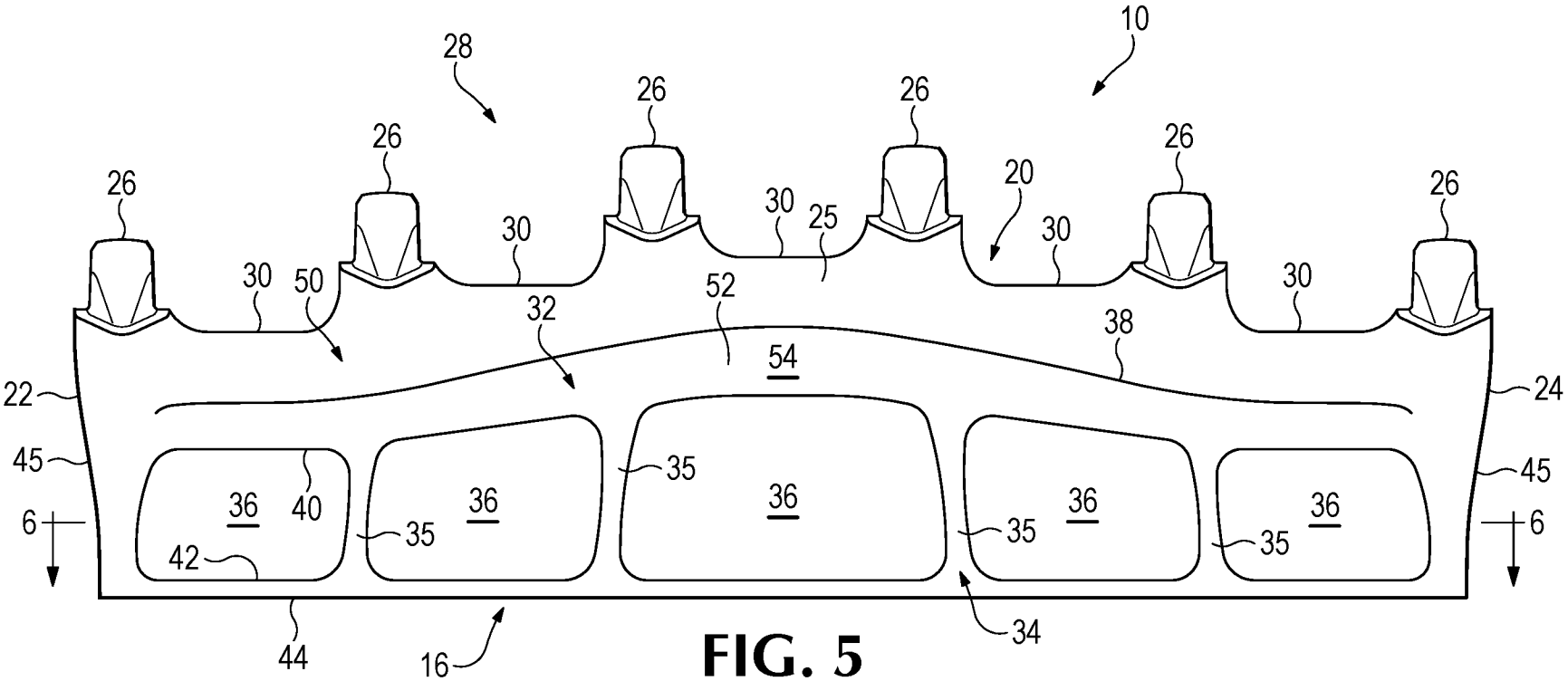
FIG. 5 is a bottom view of the inventive lip.
Figure 6:
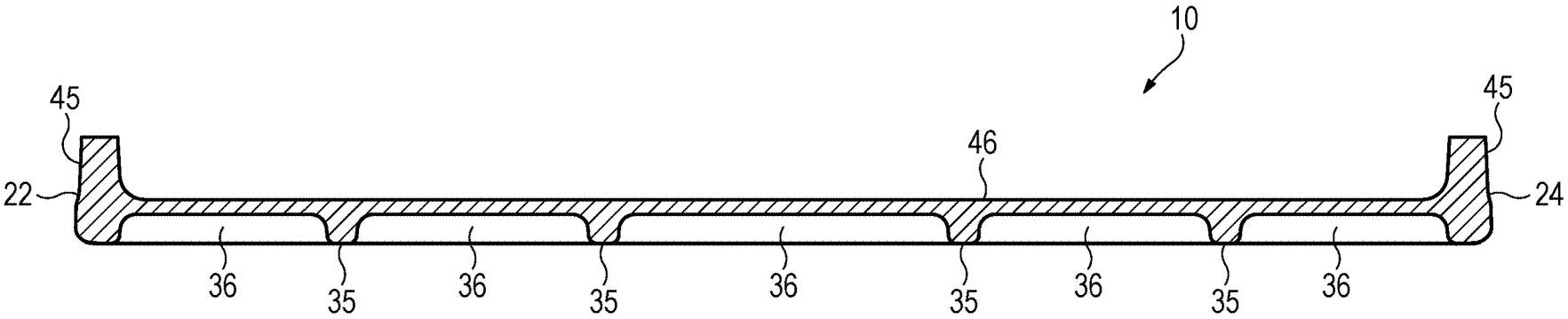
FIG. 6 is a cross sectional view along line 6-6 in FIG. 5.
Figure 7:
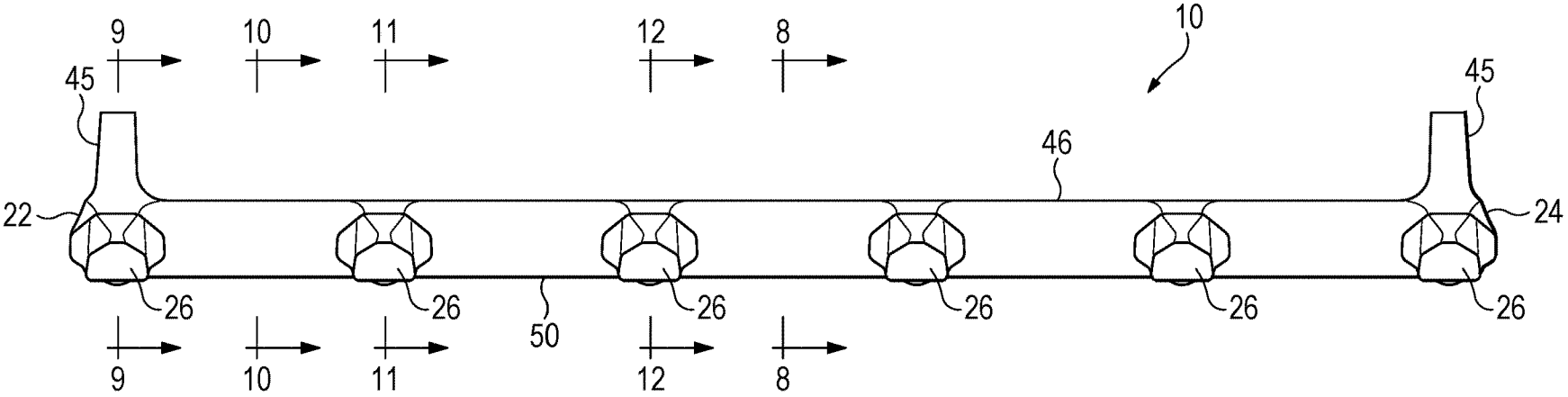
FIG. 7 is a front view of the inventive lip.
Figure 8:
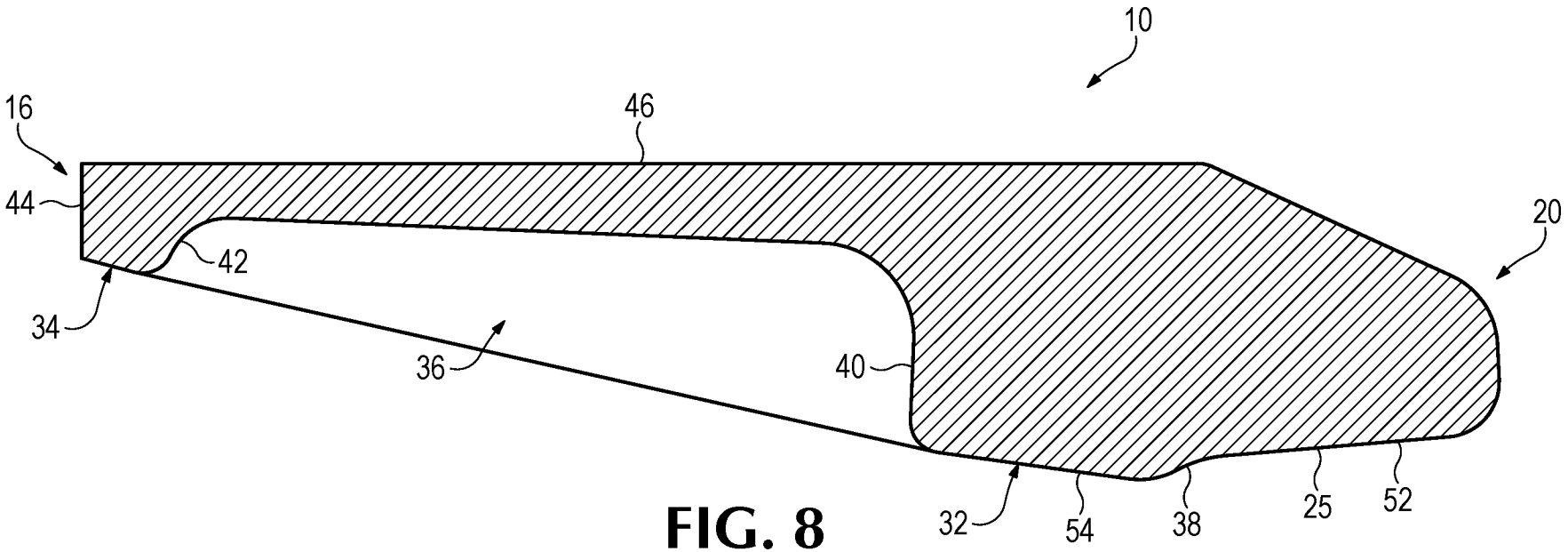
FIG. 8 is a cross sectional view along line 8-8 in FIG. 7, with the background features omitted.
Figure 9:
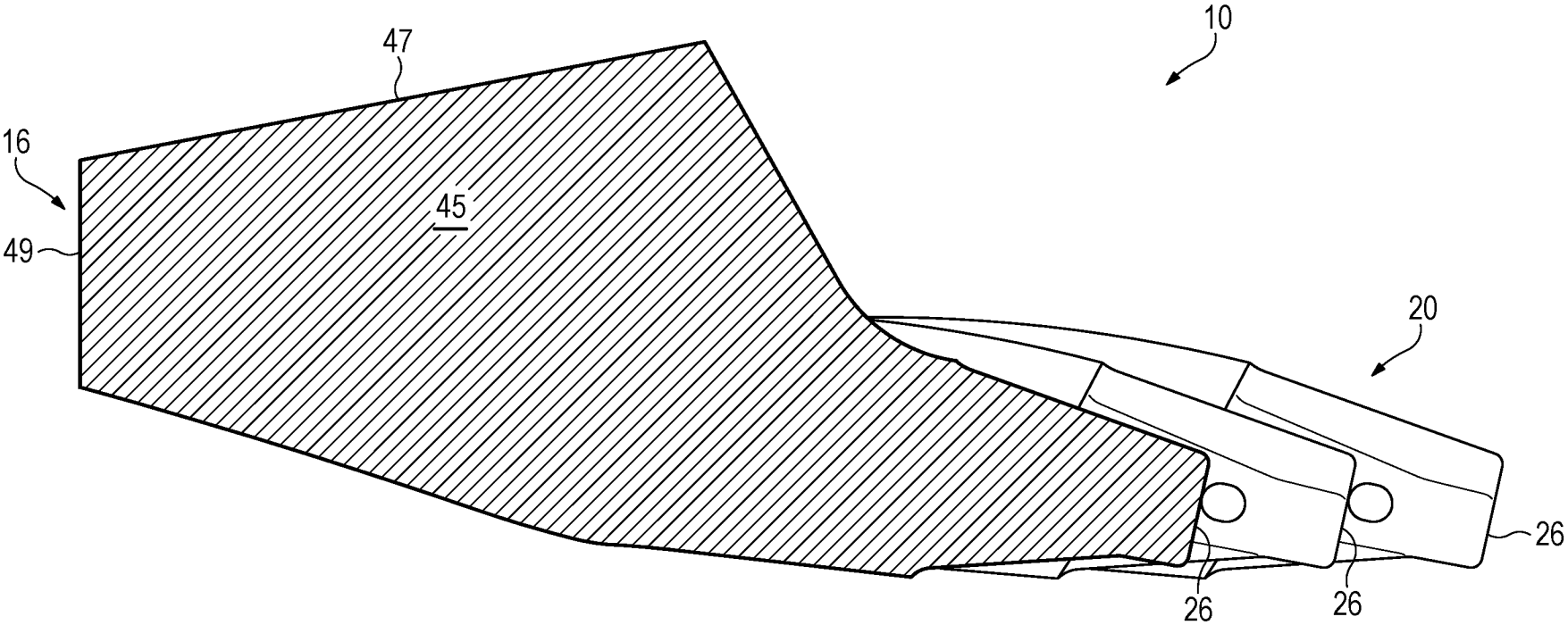
FIG. 9 is a cross sectional view along line 9-9 in FIG. 7.
Figure 10:
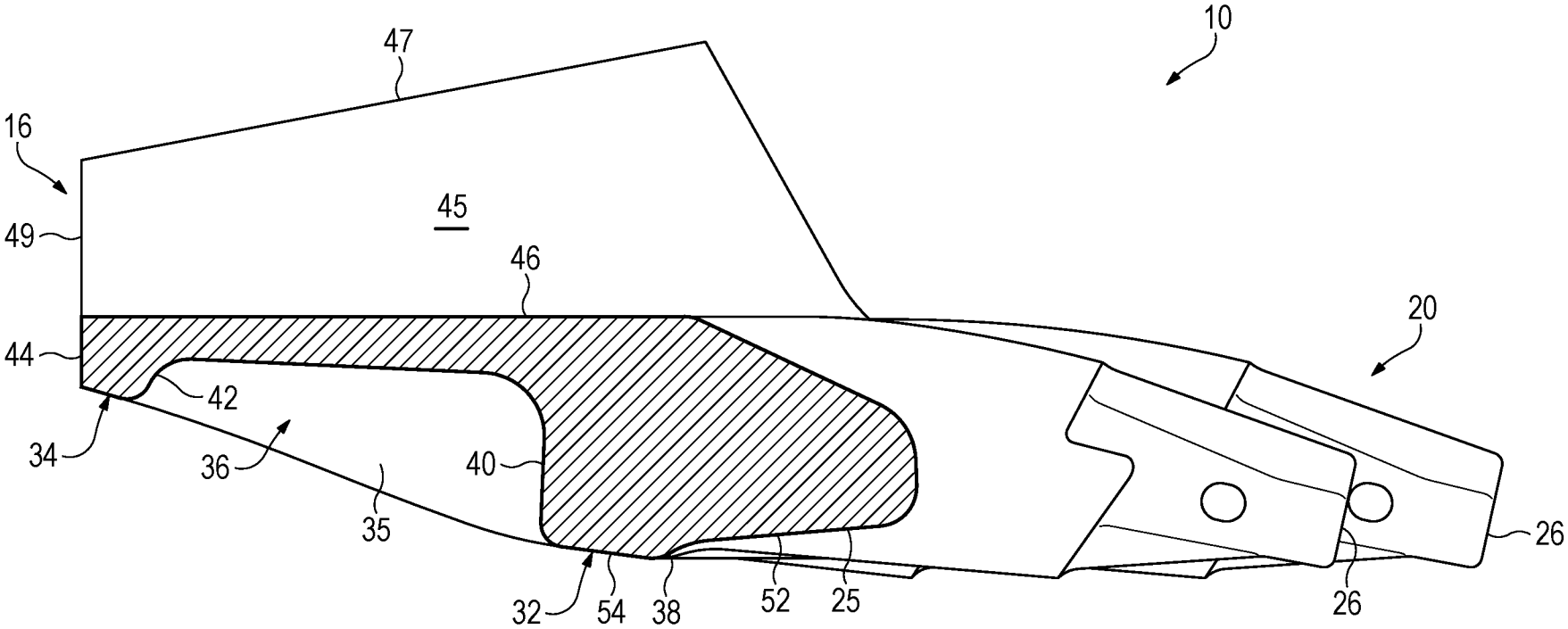
FIG. 10 is a cross sectional view along line 10-10 in FIG. 7.
Figure 11:
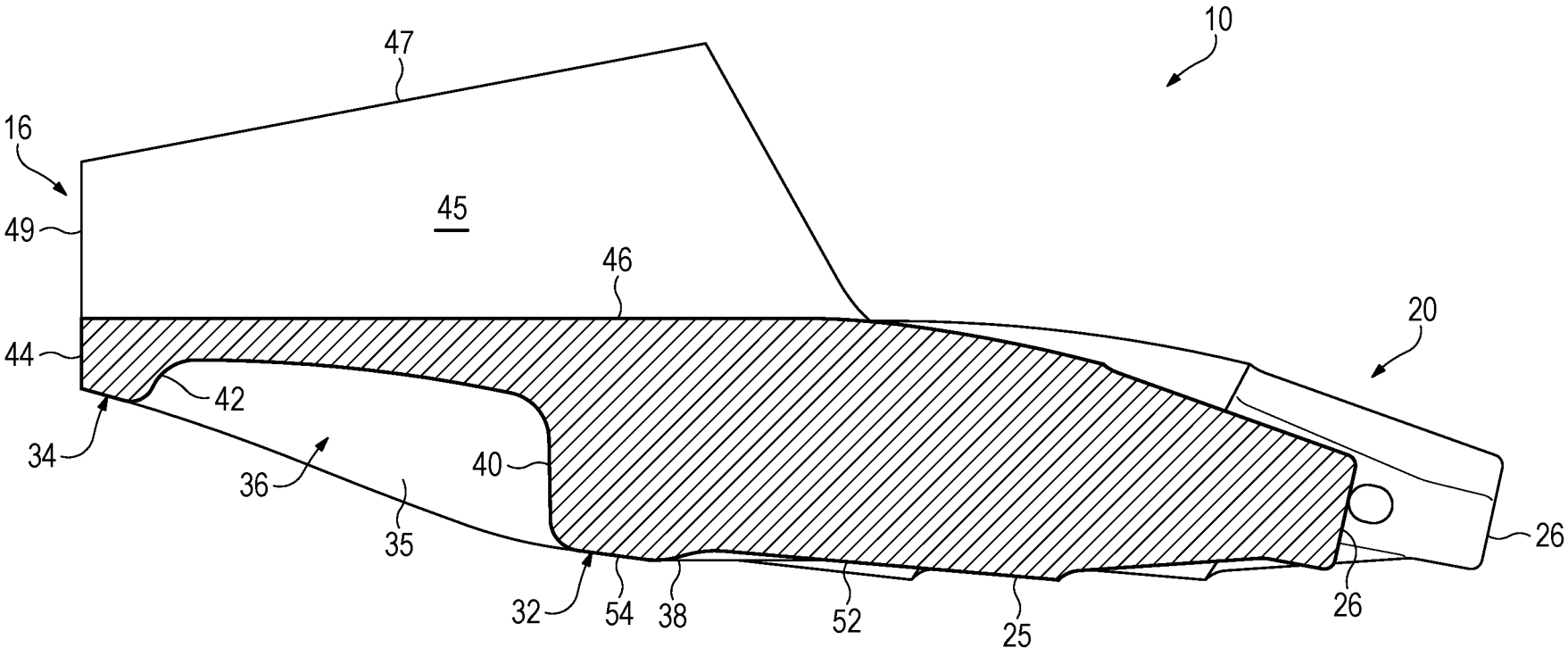
FIG. 11 is a cross sectional view along line 11-11 in FIG. 7.
Figure 12:
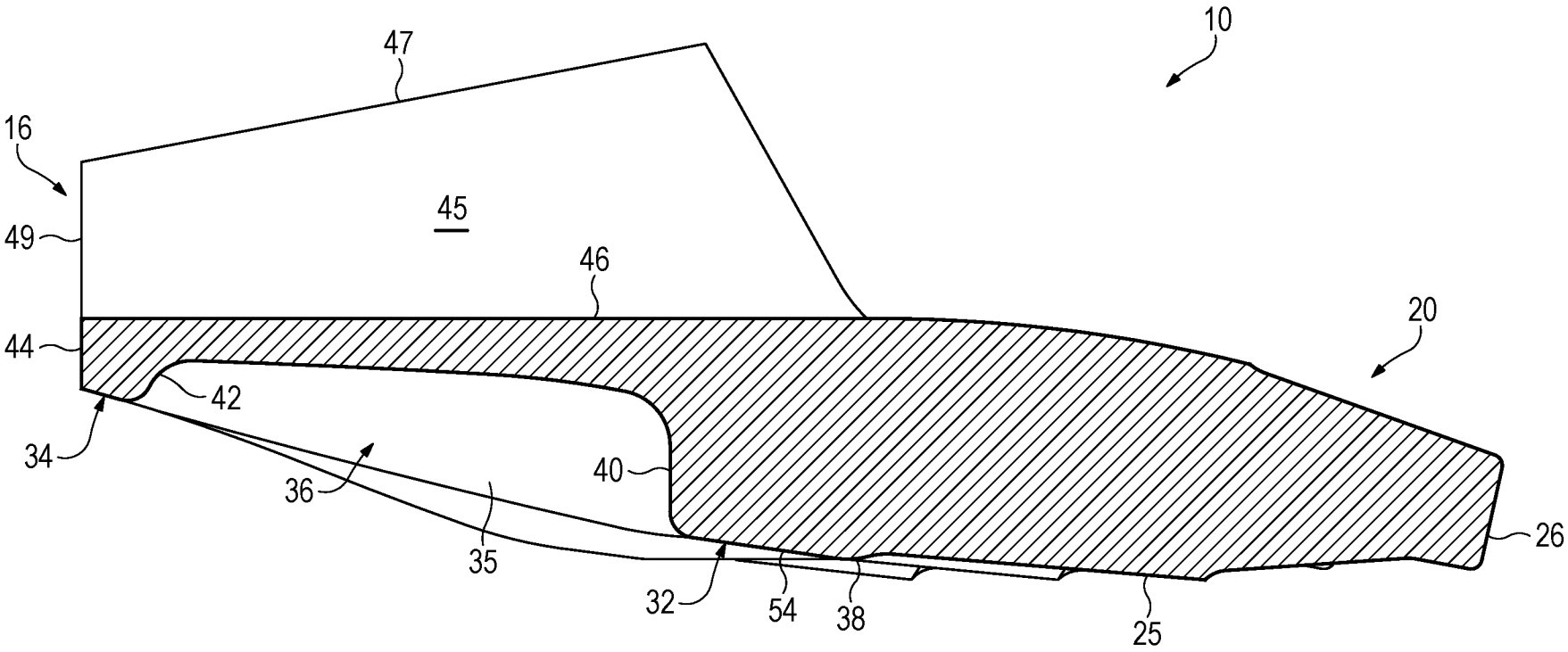
FIG. 12 is a cross sectional view along line 12-12 in FIG. 7.
Figure 13:
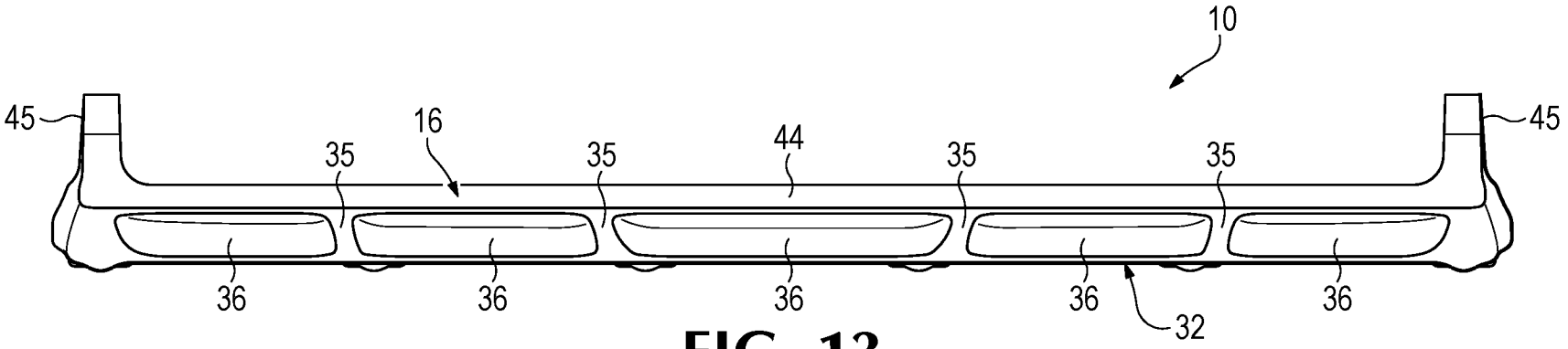
FIG. 13 is a rear view of the inventive lip.
Figure 14:
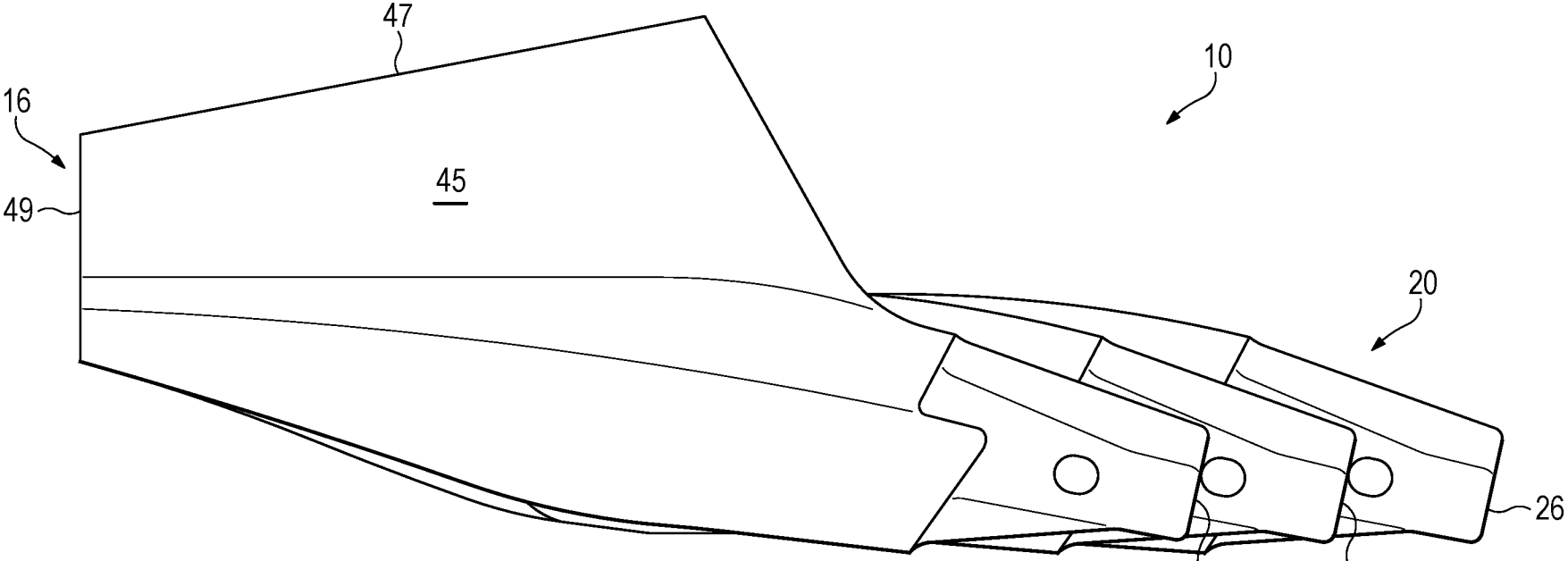
FIG. 14 is a side view of the inventive lip.

Since the illustrated embodiment is a stepped lip, front beam 32 is preferably laterally bowed such that the central section 52 is farther forward than end sections 22, 24 (FIG. 5). With this construction, the front beam could have a generally continual forward bowing as shown in FIG. 5. Alternatively, the front beam could have a pair of broad S-shaped bends to define the central forward bowing of the front beam (not shown). In this variation, the bends are preferably generally in line with the noses and the ribs. Front beam 32 can be linear with a straight lip, or bowed in the opposite direction with a reverse spade lip. Front beam 32 could have a curved configuration with the ends higher than the center of the lip when viewed from the front. The lip can take on various shapes as desired regardless of the particular kind of lip involved.

Rear beam 34 preferably has a reduced depth compared to front beam 32 for enhanced weight savings, improved penetration, reduced wearing, and to match the front of the bucket bottom wall. Rear beam 34 has a front surface 42 that slopes upward to recessed portion 36. Rear surface 44 is generally vertical to match the front of the bucket bottom wall to which it is welded along with the rear face 49 of wings 45 but can include features such as bevels to receive weld material for attaching the lip to the bucket. Rear beam 34 is preferably linear to accommodate the welding to bottom wall, but could be non-linear to facilitate attachments to other bottom wall configurations.

Ribs 35 extend laterally (i.e., front to back) between front beam 32 and rear beam 34 for increased strength and stiffness of the lip. Ribs 35 are relatively thin supports that intersect rear surface 40 of front beam 32 and front surface 42 of rear beam 34. Preferably, ribs 35 taper in depth rearward to gradually slope from the greater depth of front beam 32 to the lesser depth of rear beam 34. This taper of the ribs reduces weight, improves penetration and lessens wearing. As seen in FIG. 4, ribs 35 are preferably centered behind noses 26 to best transfer the bending moment to the rear beam 34, but they could have other positions or additional ribs in other positions could be provided. Ribs 35 can diverge outward toward the lip ends 22, 24 as they extend from the front beam to the rear beam, but they could be parallel to each other or converging in a rearward direction. The diverging ribs reduce the stress in the lip as the ribs distribute the applied loads out to the bucket. A transverse axis TA extends from the lip front to the rear of the lip perpendicular to the rear beam 44 and the ribs define a longitudinal rib axis RA. In the illustrated embodiment the rib axis inclined to the lip axis at an angle $\alpha$ of at least 5 degrees. In an alternative embodiment, a subset of ribs 35 diverge outward as they extend from the front beam to the rear beam and the balance of the ribs do not diverge.

The configuration of support structure 28 also allows ribs 35 to be narrower than the width of the nose 26 of mounting portion 25. Conventional lips have substantial ribs with widths exceeding that of the noses they support. Using a narrow rib that can provide adequate support and coupling of the front and rear beams in a way that significantly reduces the mass of the lip. Nevertheless, the ribs could have other orientations (e.g., parallel to the axes of the noses, inclined in opposite directions, and the like) and could have other configurations besides generally linear. Also, in this embodiment, wings 45 also extend between beams 32, 34 at ends 22, 24 and function in part similarly to ribs 35. The wings and ribs are collectively referred to as lateral supports.

Recessed portions 36 between beams 32 and 34 are thinner than adjacent support members and comprise a large portion of the lip. In the illustrated example, the recesses define the entire portion between beams 32, 34 except for ribs 35 and wings 45. As can be seen, the lip has a substantially reduced thickness (or depth) than either of the beams 32, 34. In this example, the centers of the recesses have depths that are less than 25% of the depth at the center of the front beam 32. Similarly, the thickness (or depth) at the center of the recesses is about 50% of the thickness at the center of the rear beam 34. Of course, other relative thicknesses could be used. Recesses 36 can be domed so that they taper in thickness from the edges to the center.

The recesses of support structure 28 make up a significant portion of the lip in order to achieve the desired weight savings. In certain preferred embodiments of the present invention, the weight-savings can be maximized beyond prior lips. For example, in these certain preferred embodiments, the total collective volume of the recesses in the lip is at least about 15% of the total volume of the lip including the volume of the recesses. In one preferred embodiment, the volume of the recesses is about 22% of the total volume of the lip. For example, the total volume of the lip is about 0.731 cubic meters, and the total collective volume of the recesses is about 0.163 cubic meters. The inventive lip can, of course, be used in lips of many different sizes and types. As a comparison, in one prior lip of comparable size, the volume of the recesses is about 12% of the total volume of the lip (including the volume of the recesses). For example, the prior lip volume of 0.80 cubic meters, and the volume of the recesses is about 0.099 cubic meters. In other prior lips, the volume of the recesses range from 7.3% to 14.1%. The prior lips lack the maximized weight-savings construction of the present invention and requires more mass and less recesses to maintain the desired strength. The invention, though, is not dependent on having a total collective volume of the recesses being at least 15% of the total volume of the lip (including the volume of the recesses). In some uses and sizes, a lip in accordance with the present invention (e.g., a lip with front and rear beams separated by one or more recesses) can have a construction where the total collective volume of the recesses is much less than 15% of the total volume of the lip (including the volume of the recesses).

This advantageous construction of using a pair of spaced apart beams 32, 34 on opposite sides of a recessed portion 36 defined largely by a substantially reduced thickness saves considerable weight in the lip. In one example, the weight savings for a lip of 15,000 pounds is about 1200 pounds. In general, weight savings are anticipated to be around 2-12%, but could be more over a conventional lip. Greater or lesser weight savings will be possible depending on the size of the lip and the type of machine.

The invention claimed is:

1. A lip for an excavating bucket comprising at least one cast body and having a length to extend between opposite sidewalls of the bucket, the lip including:

a front side and a rear side, the front side having a mounting portion to which ground engaging tools can be attached;

a front beam and a rear beam extending along most of the length of the lip to provide resistance to loads during use, each of the front and rear beams being continuous and free of angularity along substantially the length of the lip, the front beam being adjacent to and rearward of the mounting portion and being thicker than the mounting portion and the rear beam with thickness measured top to bottom, and the rear beam being along the rear side;

a top panel coupling the front and rear beams together and defining a top surface over which earthen material passes into the bucket; and a plurality of ribs interconnecting and spanning between the front and rear beams;

at least portions of the mounting portion, the front and rear beams, the top panel and the ribs being formed in the at least one cast body; and the front and rear beams being thicker than the top panel to define recesses along the ribs, underneath the top panel and between the front and rear beams, and each of the recesses opening in a direction away from the top panel.

2. The lip of claim 1 wherein the mounting portion includes noses extending forward of the front beam for mounting the ground engaging tools.

3. The lip of claim 2 wherein each said rib is in general alignment with one of the noses.

4. The lip of claim 2 wherein the ribs, in a direction parallel to the length of the body, are thinner than the noses.

5. The lip of claim 4 wherein each said rib is generally aligned with one of the noses.

6. The lip of claim 1 wherein the thickness of the top panel over the recesses is less than 25% of the thickness of the thickest point of the front beam.

7. The lip of claim 1 wherein the thickness of the top panel over the recesses is less than 50% of the thickness of the thickest point of the rear beam.

8. The lip of claim 1 wherein the front beam has a central portion between two ends, and the front beam is bowed with the central portion projecting farther forward than the ends.

9. The lip of claim 1 wherein two or more of the ribs diverge from each other as they extend from the front beam to the rear beam.

10. The lip of claim 1 wherein a plurality of cast bodies are welded together to form the lip.

11. The lip of claim 1 wherein the ribs, in a direction parallel to the length of the body, are thinner than the noses.

12. The lip of claim 1 wherein the recesses collectively define at least 15 percent of the total volume of the lip including the total collective volume of the recesses.

13. The lip of claim 1 wherein the recesses collectively define at least 18 percent of the total volume of the lip including the total collective volume of the recesses.

14. The lip of claim 1 wherein the recesses collectively define at least 22 percent of the total volume of the lip including the total collective volume of the recesses.

15. The lip of claim 1 wherein the front beam is generally curved such that at least a central part of the longitudinal axis of the front beam has a generally smooth, forwardly bowed curvature.

16. The lip of claim 1 wherein the cast body defines the entire lip and extends from one sidewall to the other sidewall.

17. An excavating bucket comprising containing walls including sidewalls defining a cavity for receiving earthen materials during a digging operation, and a lip having a length extending between opposite sidewalls of the bucket, the lip being defined by at least one cast body and including:

a front side and a rear side, the front side having a mounting portion to which ground engaging tools can be attached;

a front beam and a rear beam extending along most of the length of the lip to provide resistance to loads during use, each of the front and rear beams being continuous and free of angularity along substantially the length of the lip, the front beam being adjacent to and rearward of the mounting portion and being thicker than the mounting portion and the rear beam, the rear beam being along the rear side with thickness measured top to bottom;

a top panel coupling the front and rear beams together and defining a top surface over which earthen material passes into the bucket; and a plurality of ribs interconnecting and spanning between the front and rear beams;

at least portions of the mounting portion, the front and rear beams, the top panel and the ribs being formed in the at least one cast body; and the front and rear beams being thicker than the top panel to define a plurality of recesses underneath the top panel and between the front and rear beams, and each of the recesses opening in a direction away from the top panel.

18. The excavating bucket of claim 17 wherein the mounting portion of the lip includes noses extending forward of the front beam for mounting ground engaging tools.

19. The excavating bucket of claim 17 wherein the thickness of the lip at the recess is less than 25% of the thickness of the thickest point of the front beam.

20. The excavating bucket of claim 17 wherein the thickness of the lip at the recess is less than 50% of the thickness of the thickest point of the rear beam.

21. The excavating bucket of claim 17 wherein the front beam has a central portion between two ends, and the front beam is bowed with the central portion projecting farther forward than the ends.

22. The bucket of claim 17 wherein the cast body defines the entire lip and extends from one sidewall to the other sidewall.

23. The bucket of claim 17 wherein a plurality of cast bodies are welded together to form the lip.

24. A lip for an excavating bucket defined by at least one cast body and having a length to extend between opposite sidewalls of the bucket, the lip comprising:

a front beam and a rear beam extending substantially along the length of the lip to provide support for loads during use, each of the front and rear beams being continuous and free of angularity in direction along substantially the entire length of the lip;

a plurality of forwardly projecting noses forward of the front beam for supporting ground engaging tools;

a top panel coupling the front and rear beams together and defining a top surface over which earthen material passes into the bucket; and a plurality of ribs extending between the front and rear beams, the front and rear beams being thicker than the top panel to define recesses along the ribs, underneath the top panel and between the front and rear beams, wherein each of the ribs is generally aligned with one of the noses.

25. The lip of claim 24 wherein the ribs, in a direction parallel to the length of the body, are thinner than the noses.

26. The lip of claim 24 wherein the recesses are collectively at least 15 percent of the total volume of the lip including the total collective volume of the recesses.

27. The lip of claim 24 wherein the recesses collectively define at least 18 percent of the total volume of the lip including the total collective volume of the recesses.

28. The lip of claim 24 wherein the recesses collectively define at least 22 percent of the total volume of the lip including the total collective volume of the recesses.

29. The lip of claim 24 wherein the noses are part of a mounting portion forward of the front beam to support the ground engaging tools, wherein the front beam is thicker top to bottom than the mounting portion.

30. The lip of claim 29 wherein the front beam includes a rear surface that defines the front of the recesses, and a bottom surface that extends between the mounting portion and the rear surface, and wherein the bottom surface slopes upward in a rearward direction.

31. The lip of claim 24 wherein the front beam is thicker top to bottom than the rear beam.

32. The lip of claim 24 wherein the front beam is curved such that at least a central part of the longitudinal axis of the front beam has a smooth, forwardly bowed.

33. The lip of claim 32 wherein the rear beam is generally linear.

34. The lip of claim 24 wherein each of the ribs taper in thickness top to bottom as the ribs extend rearward.

35. The lip of claim 24 wherein two or more of the ribs diverge from each other as they extend from the front beam to the rear beam.

36. The lip of claim 24 wherein the cast body defines the entire lip and extends from one sidewall to the other sidewall.

37. The lip of claim 24 wherein a plurality of cast bodies are welded together to form the lip.

38. A lip for an excavating bucket defined by at least one cast body and having a length to extend between sidewalls of the bucket, the lip comprising:

a front beam and a rear beam extending uninterrupted along at least most of the length of the lip;

a top panel extending between the front and rear beams and defining a top surface over which earthen material passes into the bucket;

a mounting structure extending forward of the bucket including a plurality of forwardly projecting noses each for mounting a tooth component, and a plurality of mounting areas for mounting shrouds between the noses;

a plurality of ribs extending between the front and rear beams underneath the top panel; and a plurality of recesses defined between the front and rear beams alongside of the ribs;

wherein the lip tapers to a smaller thickness in forward and rearward directions from the front beam and each of the front and rear beams is free of angularity in direction and dimension.

39. An excavating bucket comprising containing walls including sidewalls defining a cavity for receiving earthen materials during a digging operation, and a lip being defined by at least one cast body and having a length extending between opposite sidewalls of the bucket, the lip including:

a front beam and a rear beam extending along the length of the lip to provide resistance to loads during use, each of the front and rear beams being continuous and free of angularity along substantially the entire length of the lip;

a plurality of forwardly projecting noses forward of the front beam for supporting ground engaging tools;

a top panel coupling the front and rear beams together and defining a top surface over which earthen material passes into the bucket; and a plurality of ribs extending between the front and rear beams, the front and rear beams being thicker than the top panel to define recesses along the ribs, underneath the top panel and between the front and rear beams, wherein each of the ribs is generally aligned with one of the noses.

40. The lip of claim 39 wherein the rear beam is generally linear.

* * * * *